US005813418A

United States Patent [19]

Pillars

[11] Patent Number: 5,813,418

[45] Date of Patent: Sep. 29, 1998

[54] HAIR CLIP DEVICE AND METHOD FOR ATTACHING HAIR EXTENSIONS

[76] Inventor: Selina M. Pillars, 6731 Arlington Ave., Los Angeles, Calif. 90043

[21] Appl. No.: 965,778

[22] Filed: Nov. 7, 1997

Related U.S. Application Data

[60] Provisional application No. 60/029,955 Nov. 8, 1996.

[51] Int. Cl.[6] ..... A41G 3/00; A41G 5/00

[52] U.S. Cl. ..... 132/201; 132/207; 132/144; 132/279; 132/212

[58] Field of Search ..... 132/207, 144, 132/148, 278, 279, 219, 126, 129, 130, 132, 145, 146, 276, 277, 201, 212

[56] References Cited

U.S. PATENT DOCUMENTS

| | | | |
|---|---|---|---|
| 673,098 | 4/1901 | Tissier . | |
| 1,052,310 | 2/1913 | Burlando . | |
| 1,594,741 | 8/1926 | Lewis | 132/126 |
| 1,775,209 | 9/1930 | Oppenheim | 132/130 |
| 5,402,805 | 4/1995 | Barinas | 132/148 |
| 5,445,170 | 8/1995 | Yasuda . | |
| 5,533,533 | 7/1996 | Shing | 132/279 |

FOREIGN PATENT DOCUMENTS

| | | | |
|---|---|---|---|
| 661549 | 11/1951 | United Kingdom | 132/278 |

*Primary Examiner*—Gene Mancene
*Assistant Examiner*—Pedro Philogene
*Attorney, Agent, or Firm*—Richard C. Litman

[57] ABSTRACT

A color matched hair clip device with and without an unlocking key combination, and a method for adding and removing multiple hair extensions or tracks to a person's head without resorting to sewing or gluing as practiced conventionally. The hair clip device is made up of a comb element and a cover element which "Ziplocs"™ with a locking guard element in the first embodiment. The U-shaped locking guard has a hooked sheath at each end. The cover element has two track snaps or hair extension holders under which the hair extensions are attached. The second embodiment dispenses with the locking guard and utilizes plastic snaps for both the hair extension holders, the comb teeth and the cover element for securing the hair extensions. The method of use comprises placing the comb element close to the scalp, engaging the end teeth of the comb with the sheathed ends of the locking guard, wrapping the natural hair around the comb to be held initially by the sheathed locking guard's external hooks, and either interlocking the cover element with the locking guard or snapping the hair extension holders and the cover element for securing the hair extensions. A special key is provided for removal of the locking guard or the snaps of the hair clip device and the attached hair extensions. The key is designed to effectively perform the operation with a minimum of effort and without damaging the hair clip device.

20 Claims, 3 Drawing Sheets

HAIR CLIP DEVICE AND METHOD FOR ATTACHING HAIR EXTENSIONS

CROSS-REFERENCE TO RELATED APPLICATION

This application claims the benefit of U.S. Provisional patent application Ser. No. 60/029,955, filed Nov. 8, 1996.

BACKGROUND OF THE INVENTION

1. Field of the Invention

The present invention relates to an innovative hair clip device and a method for adding hair extensions.

2. Description of the Related Art

Presently, beauticians will stylize a customer's hair to add hair extensions, natural or synthetic, which may or may not match the texture and color of the customer's natural hair according to the customer's desire. However, the tedious operation takes approximately 5 hours for sewing in the extensions with thread and glue. There is a need for saving the time and expense of this hair lengthening process, by being able to perform the operation by oneself at home in half the required time and dispensing with threading and gluing.

The present invention permits a person with straight, curly, wavy or braided hair to attach hair extensions which can be any color, style and length. The clip-in device will not irritate or cause discomfort to the user's scalp even though it is placed close to the scalp. Furthermore, an important advantage is the ability to wash one's hair with the color matching hair clips engaged with the hair extensions. An added advantage accruing is that one's own hair is given a rest period of several months from repeated drying and breakage due to visits to the beauty parlor. The prior art does not suggest the present invention; related art is discussed below in the order of perceived relevance.

U.S. Pat. No. 5,402,805 issued on Apr. 4, 1995, to Mary S. Barinas describes an adjustable level barrette device comprising a barrette member and a comb member. The barrette member consists of two elongated combed elements joined at a lower end and closable at the top end. The barrette member can have two configurations, wherein one configuration has straight backed combed elements without apertures for attaching the comb element, and the other configuration has comb attachment apertures along both curved backs. The barrette member is always attached vertically. After a portion of the native hair having a width commensurate with the width of the barrette member is trapped in the vertical barrette member, the comb element having sharp pointed teeth is attached horizontally to the barrette member at any level in either embodiment. There is no suggestion for utilizing the adjustable level barrette device to add on additional hair.

U.S. Pat. No. 1,052,310 issued on Feb. 4, 1913, to John A. Burlando describes a cooperating comb and barrette combination adapted to prevent the loss of either component. The hollow rectangular barrette has lugs with headed pins at its ends which engage slots located at the lower edges of the outside teeth of the comb. There is no suggestion for attaching another length of hair to the device.

U.S. Pat. No. 5,533,533 issued on Jul. 9, 1996, to Yeh S. Shing describes a foldable hair clip with a comb. The combination device functions as either a hair clip, a comb or a hair fork. The comb is mounted on the inner surface of a curved clip plate and can be released and extended out to function as either a comb or a hair fork. A clip strip having short teeth is mounted by a pivot on the inside of the clip plate. There is no suggestion for attaching another hair extension to this device.

U.S. Pat. No. 5,445,170 issued on Aug. 29, 1995, to Masahiro Yasuda describes an ornamental hair clip consisting of three parts, i.e., a base plate with hooking arms at one end and retaining ledges for hinging the hair retainer with a restoring member positioned in between. The object is to retain the enclosed hair by a spring force. There is no suggestion for attaching another hair extension to this device.

U.S. Pat. No. 673,098 issued on Apr. 30, 1901, to Charles Tissier describes a hair-retaining comb. The rectangular comb with an open center has its short teeth angled away from the comb and positioned along the bottom edge. Another comb with longer teeth angled out, but having a shorter length is attached to an arm which is hinged at one end of the rectangular comb. The opposite end of the arm locks with the rectangular comb. The second hinged comb is closed down over the shorter teeth of the rectangular comb to hold the entrapped hair. There is no suggestion for adding a hair extension to this comb.

U.K. Patent Specification No. 661,549 published on Nov. 21, 1951, to James R. McEleney describes a hair fastener which comprises a curved comb having teeth with an aligned slotted guide way for receiving a slider element to clamp the hair between the teeth of the comb. There is no suggestion for adding more hair to the hair fastener.

None of the above inventions and patents, taken either singly or in combination, is seen to describe the instant invention as claimed.

SUMMARY OF THE INVENTION

Accordingly, it is a principal object of the invention to provide a color-matching hair clip device and a method for adding hair extensions of any straight, curly, wavy or braided hair.

It is another object of the invention to provide a hair clip device comprising the elements of a comb and an interlocking cover with a locking guard.

It is a further object of the invention to provide a hair clip device with two track snaps on the cover element under each of which hair extensions are attached.

Still another object of the invention is to provide the cover element with an underside groove and a comb with a whitened region coinciding with the groove to accommodate the trapped hair.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
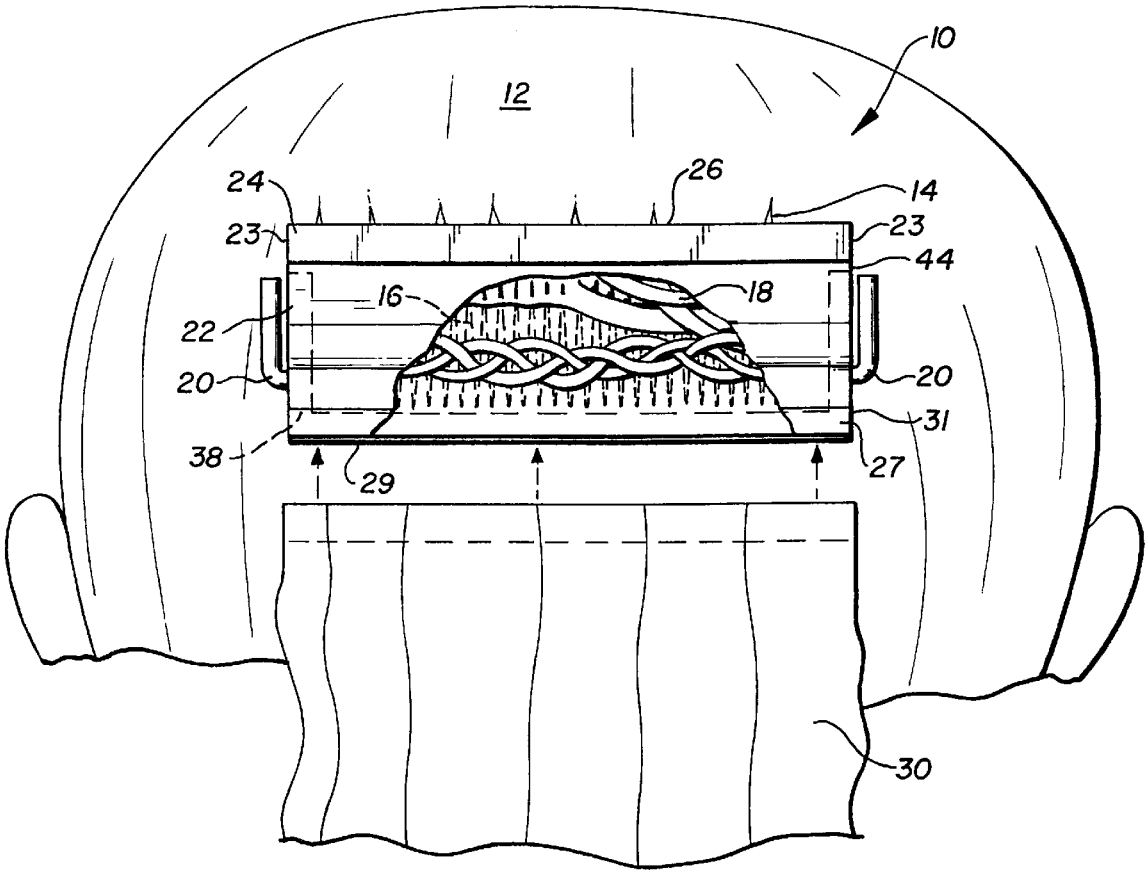
FIG. 1 is an environmental elevational view with a partial breakaway of the hair clip device as a first embodiment positioned on the scalp with one hair extension partially shown in a disengaged position.
Figure 2:
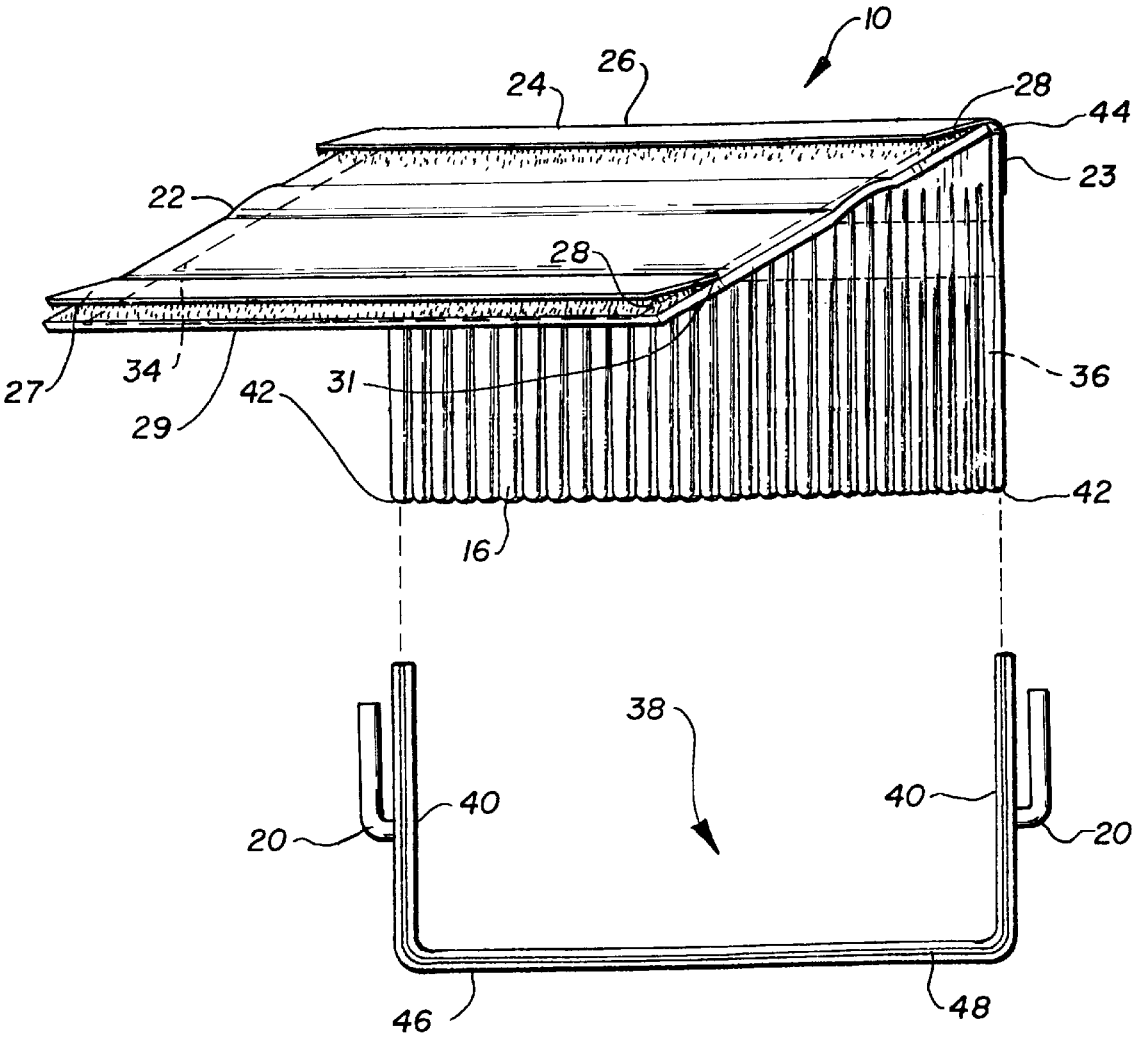
FIG. 2 is an exploded front view of the FIG. 1 hair clip device in a disengaged position to show a comb with two track snaps on the cover and a locking guard with hooks.
Figure 3:
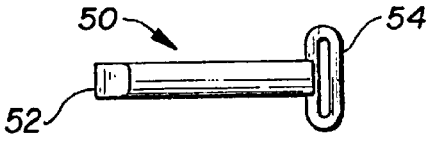
FIG. 3 is front view of a rigid plastic key for unlocking the secured cover from the locking guard of the FIG. 1 device.

A first embodiment of the present invention is shown in FIGS. 1–3 as a hair clip device 10 in a closed position applied to a head 12 having a strand of hair 14 entering the upper portion of the slightly curved and flexible comb element 16. The device 10 is placed close to the scalp, usually in a horizontal position. If the trapped hair 14 is unbraided, it can be formed into a loose braid 18 (from three hair segments) which is wrapped around the longitudinal axis of the comb element 16 and secured with the aid of extended hooks 20 positioned on the end portions of the comb element 16.

Turning to FIG. 2, the slightly curved and flexible plastic cover element 22 is coextensive in area with the comb element 16, and attached thereto by the rear flange or hinge 23 of the first or upper flexible plastic track snap or hair extension holder 24 which is located along the top edge 26 of the device 10. The cover element 22 is also made of flexible plastic. The first track snap 24 has hinges 44 to permit the opening up and closing down of the first track snap 24 over the thickened track portion of a first hair extension 30. The first track snap 24 has a series of short teeth or pins 28 spaced along its length on its underside and on top of the cover element 22 in order to secure the first hair extension 30 (see FIG. 1). A flexible second or lower track snap 27 is positioned along the bottom edge 29 of the cover element 22 with a pair of internal hinges 31 (hidden) proximate to each end for attaching a second hair extension 30 with its series of teeth or pins 28 in the event a fuller hair effect is desired.

The cover element 22 has the following essential features. The cover is made from flexible plastic approximately an eighth of an inch thick in order to have a half-inch wide shallow groove 32 on its underside which traverses the length of the cover and holds the wrapped around hair. The cover element 22 has a male attachment means, a Ziploc™ 34, formed on three edges of its underside.

In order to aid in the alignment of the hair being wrapped around the comb element 16 with the shallow groove 32 of the cover element 22, a half-inch wide whitened guide strip area 36 is provided on the exposed surface of the comb element 16.

A U-shaped and slightly curved plastic locking guard 38 is than used to secure the cover element 22 to the comb element 16. The sleeved legs 40 are hollow and permit the end teeth 42 of the comb element 16 to be inserted almost up to the top edge 26 of the comb element 16. The top surface 46 of the locking guard 38 has a female attachment means, Ziploc™ 48, which is coextensive with the guard 38. The locking guard 38 functions also to stabilize the comb element 16 for forming the hair braid 18. It is contemplated that the positions of the attachment means 34 and 48 on the cover element 16 and the locking guard 38, respectively, can be reversed.

The trapped strand of hair 14 can now be covered by interlocking the "Ziplocs"™ 34 with 48. Now, the first and second hair extensions 30 can be secured by the teeth or pins 28 of the track snaps 24 and 27.

Although only a single hair clip device 10 has been illustrated, it is understood that multiple clip devices 10 of various sizes and matching colors can be employed to cover the hair growth on one's head. The clip devices 10 are not limited to application horizontally and can be inclined according to the region of the head affected. The comb elements 16 and the locking guards 38 also must have the flexibility required for conforming to the surface of the head 12.

When the device 10 is to be removed, a rigid plastic key 50 depicted in FIG. 3 is utilized to unlock the Ziploc securement by inserting the nib 52 of the key 50 having a ringed handle 54 into the space of the hinge 44 (FIG. 2) to initiate the unlocking procedure. This unlocking method would prevent unwanted tearing of the cover element 22. The hair extensions 30 can be removed from the hair clip device 10 by inserting the nib 52 of the key 50 underneath the lower edges of the track snaps 24 and 27 to open up the track snaps.

Figure 4:
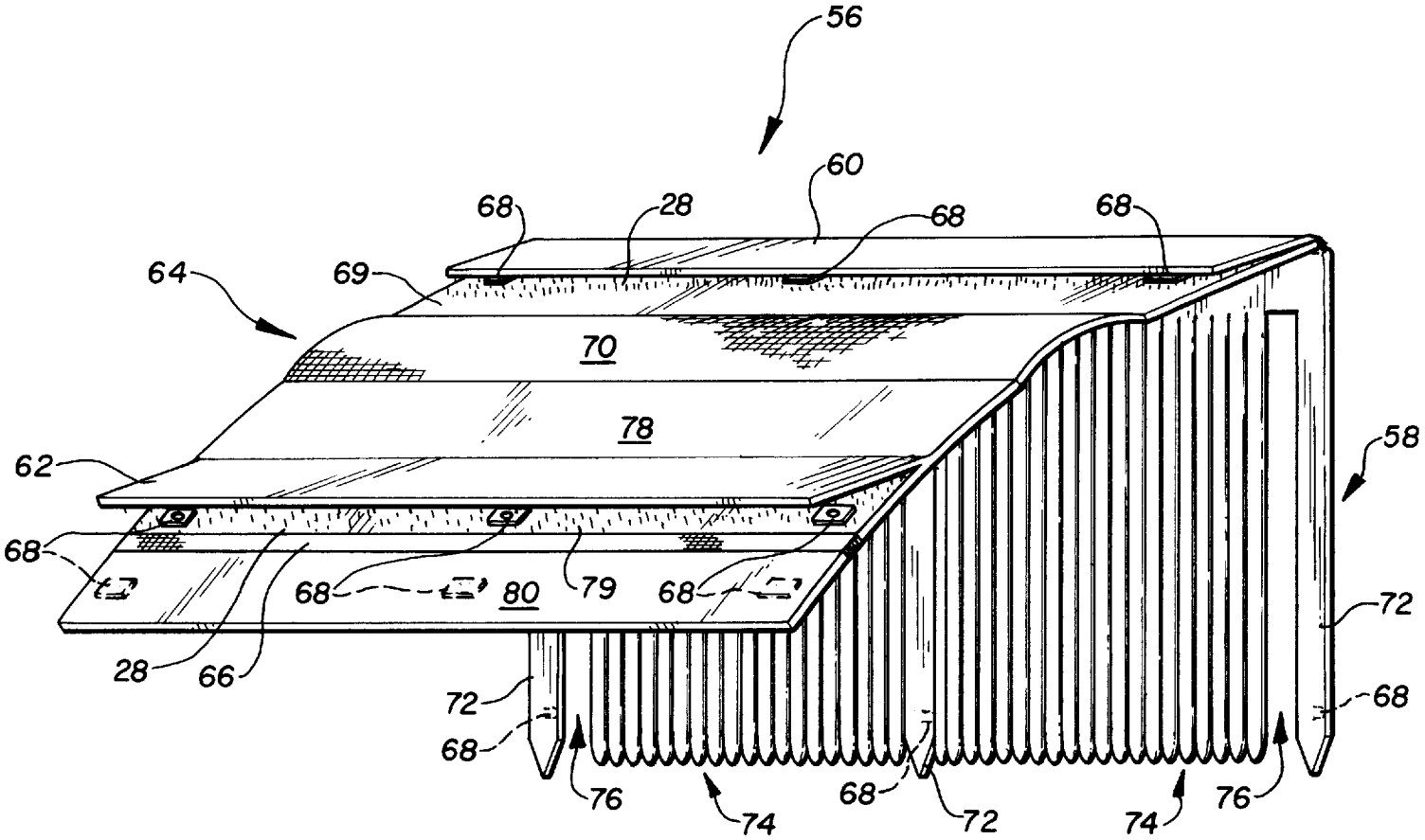
FIG. 4 is a front perspective view of a second embodiment of the present invention for attaching hair extensions.

FIG. 4 depicts a second embodiment of a one-piece hair clip device 56 omitting a locking guard, inter alia. The device 56 has a slightly curved plastic colored comb element 58 (to conform to the curvature of the head) with a first or upper hair extension holder 60 and a second or lower hair extension holder 62 hinged on the cover element 64 attached to the comb element 58 by internal fabric (or integrated) hinges 66. Each hair extension holder 60, 62 has teeth or pins 28 and an exemplary set of three plastic female snaps 68 on its underside surface for securing the holders to the cover element 64 which has cooperating male snaps 68. Larger versions or smaller versions of the hair clip device 56 need four or two snaps 68, respectively. The bulging plastic meshed region 70 provides room for the braided hair 18. The comb element 58 is structured differently with outside teeth 72 and an intermediate tooth 72 which are wider than the uniformly narrower included teeth 74. Spaces 76 are provided between the outside teeth 72 and the adjacent inner teeth 74.

The cover element 64 is fastened to the comb element 58 after the person's hair has been braided into either "French braids" or "corn rolls" (braids which have their entire bodies connected to the scalp), and the comb element 58 positioned between the braids and the scalp by bending over the hinged (hinge 66) flap portion 80 having a set of three plastic female snaps 68 underneath (shown in shadow) which cooperate with a matching set of male snaps 68 on the underside (shown in shadow) of each of the three large comb teeth 72. Alternatively, the positions of the female and male snaps can be reversed. Subsequently, two hair extensions 30 (FIG. 1) of a matching color to the hair clip device 56 and the person's hair 14 are attached by closing the snaps 68 on the first and second hair extension holders 60, 62. Thus, hair extensions 30 can be readily attached and changed by the use of the hair clip device 56.

Therefore, the hair clip device 56 for attaching hair extensions 30 comprises a flexible and curved comb element 58 having its outside teeth 72 broadened and spaced from its inner more narrow teeth 74, said outside teeth 72 having a fastening means 68 on a rear surface proximate each tip of said teeth 72. The flexible cover element 64 comprises the following contiguous regions: (a) an uppermost region 69 with teeth or pins 28 being hingedly attached to an uppermost region of said comb element 58; (b) an outwardly bulging meshed region 70; (c) a planar region 78; (d) a pinned region 79; (e) a book-like fabric hinge region 66; and (f) a lowermost planar region 80 adapted to be bent backward over teeth 72 and 74 to be snapped to the rear of teeth 72 and 74.

A first upper planar hair attachment holder panel 60 with pins 28 is hingedly attached to the rear of said uppermost region 69 of said comb element 58. A second planar hair attachment holder panel 62 with pins 28 is hingedly and integrally attached to said planar region 78; whereby a hair extension 30 (FIG. 1) can be attached by its gathered end under each of said first and second hair attachment holder panels 60, 62, respectively.

The key 50 of FIG. 3 can also be utilized to unsnap the hair clip device of FIG. 4 for removal from the head 12.

The hair clip devices 10 and 56 can have the exemplary dimensions of 1.5, 3 and 4 inches in length with corresponding widths of 0.5 to 1.25 inches. The widths of the groove 32 and its corresponding whitened region 36 in the embodiment of FIGS. 1–3 will be commensurate with the relative sizes of the hair clip device 10. The hair clip devices 10 and 56 can be prepared in toto by injection molding of plastic compositions. The color of the device is coordinated with the color of the hair extension. The hair clip device can be utilized by the user or applied by an untrained helper. The device will not irritate or cause discomfort to the scalp, because the curved comb is smooth and flexible enough to conform to the curvature of the head. The hair clips can be left on the head for several months, and the head can be shampooed by disengaging the hair extensions.

It is to be understood that the present invention is not limited to the embodiments described above, but encompasses any and all embodiments within the scope of the following claims.

I claim:

1. A hair clip device for adding hair extensions comprising:

a flexible curved comb element having a unitary top edge along its length with long comb teeth extending from said top edge; a flexible cover element hinged to the top edge of and coextensive in area with said comb element, said cover element having a median region for accommodating space for braided hair;

a first flexible hair extension holder having short pins on its underside which cooperate with short pins on said comb element, and hinged to the top edge of said cover element; and a second flexible hair extension holder having short pins on its underside which cooperate with short pins on said comb element, and hinged proximate to the bottom edge of said cover element;

whereby a user's hair is trapped by said comb element and said cover element for attachment of hair extensions under said hair extension holders.

2. The hair clip device according to claim 1, said hair clip device being uniformly colored to match the color of said hair extensions being attached.

3. The hair clip device according to claim 1, said hair clip device having attachment means for securing said cover element to said comb element and a key for detaching said attachment means.

4. The hair clip device according to claim 3, wherein said attachment means comprises a U-shaped locking guard having sleeved legs with external hooks for wrapping and securing the user's hair.

5. The hair clip device according to claim 4, said cover element having a cooperating attachment means on its lower surface along its unattached edge.

6. The hair clip device according to claim 5, said attachment means for said U-shaped locking guard being a female strip, and said cooperating attachment means of said cover element being a male strip to close three sides of said hair clip device.

7. The hair clip device according to claim 1, said median region of said cover element having a horizontal groove on an undersurface.

8. The hair clip device according to claim 7, said comb element having a whitened region commensurate with said horizontal groove for alignment purposes.

9. The hair clip device according to claim 3, said flexible curved comb element having its outside teeth broadened and spaced from its inner more narrow teeth, said outside teeth having said attachment means on a rear surface proximate each tip of said teeth for securing said cover element.

10. The hair clip device according to claim 9, wherein said attachment means further comprises cooperating attachment means on an undersurface of said cover element.

11. The hair clip device according to claim 10, wherein said attachment means for said comb element and said cover element comprises snaps.

12. A hair clip device for attaching hair extensions comprising:

a flexible and curved comb element having outside teeth and inside teeth, said outside teeth broadened and spaced from said inside teeth, said inside teeth being more narrow than said outside teeth, said outside teeth having a fastening means on a rear surface proximate each tooth tip of said teeth;

a flexible cover element comprising the following contiguous regions:

(a) an uppermost region, hingedly attached to an uppermost region of said comb element;

(b) an outwardly bulging meshed region;

(c) a planar region;

(d) a hinge region; and (e) a lowermost planar region adapted to be bent backward;

a first planar hair attachment holder panel hingedly attached to said uppermost region of said comb element; and a second planar hair attachment holder panel hingedly attached to said planar region;

whereby a hair extension being attached by its gathered end under each of said first and second hair attachment holder panels.

13. The hair clip device according to claim 12, said first and second hair attachment holder panels having short pins on the underside of each hair attachment holder which cooperate with short pins on an upper surface of said cover element.

14. The hair clip device according to claim 12, said fastening means between said first and second hair attachment holder panels being a plurality of snaps on a bottom surface for cooperation with snaps on said upper surface of said cover element.

15. The hair clip device according to claim 14, there further being additional cooperating snaps positioned on an intermediate location of each said holder panel and said cover element.

16. The hair clip device according to claim 12, said lowermost planar region of said cover element being adapted to be bent backward and over said outside and inside teeth, and having snaps on a rear surface which cooperate with corresponding snaps on a rear surface of each of said outside broadened teeth of said comb element, whereby said cover element being secured to said comb element.

17. The hair clip device according to claim 16, said lowermost planar region having an first additional snap in an intermediate region, there further being a broadened intermediate tooth in said comb element, and a second additional snap on said broadened intermediate tooth, said first additional snap cooperating with said second additional snap on said broadened intermediate tooth of said comb element.

18. The hair clip device according to claim 12, said hair clip device being color matched to said hair extensions.

19. The hair clip device according to claim 12, said hair clip device being plastic.

20. A method of attaching and detaching a colored hair extension to natural hair by using a color matched hair clip device comprising:

forming braids of hair on a scalp;

placing a comb element having teeth of a color matched hair clip device close to the scalp to trap braids of hair between the comb teeth, the comb element having a snap on a rear surface end of each outside tooth of the comb element;

closing a cover element attached to a top edge of the comb element and having a first and a second hair extension holder panel positioned at the top edge and a bottom edge of the comb element, respectively, and having pins on the underside of each hair extension holder panel for cooperation with pins on a front surface of said cover element; said cover element having a median bulging region for accommodating braids of hair, and a plurality of snaps for cooperation with snaps on the outside comb teeth;

attaching and color matching a hair extension to each of the hair extension holder panels, so that the hair clip device and the hair extensions have identical colors; and removing the hair extensions from the hair clip device by detaching the cover element from the comb element by unsnapping said snaps with a key when the hair extensions have deteriorated for replacement.

* * * * *